US007105057B1

(12) United States Patent
Colussi et al.

(10) Patent No.: US 7,105,057 B1
(45) Date of Patent: Sep. 12, 2006

(54) ADJUSTABLE PAINT GUARD FOR DOOR FRAMES

(76) Inventors: Barry B. Colussi, 583 E. Maiden St., Washington, PA (US) 15301; William M. Kurek, 169 Morrison Dr., Pittsburgh, PA (US) 15216

( * ) Notice: Subject to any disclaimer, the term of this patent is extended or adjusted under 35 U.S.C. 154(b) by 0 days.

(21) Appl. No.: 10/907,359

(22) Filed: Mar. 30, 2005

(51) Int. Cl.
*B05C 21/00* (2006.01)

(52) U.S. Cl. ..... 118/504; 118/505; 160/216; 160/221; 160/227; 160/228

(58) Field of Classification Search ..... 118/504, 118/505; 427/282; 160/216, 218, 221, 222, 160/226, 227, 228
See application file for complete search history.

(56) References Cited

U.S. PATENT DOCUMENTS 1,593,183 A * 7/1926 Lindermayr ..... 160/221
3,565,038 A 2/1971 Barriger
4,196,692 A * 4/1980 Vanstrom ..... 118/504
4,276,852 A 7/1981 Adams
4,411,219 A 10/1983 Keith et al.
4,620,503 A 11/1986 Pullens
4,791,007 A 12/1988 Gleason et al.
5,429,677 A 7/1995 Brown
5,494,519 A * 2/1996 Jeffrey, Jr. ..... 118/504
5,853,811 A 12/1998 Poague
6,103,974 A 8/2000 Erdfarb

* cited by examiner

*Primary Examiner*—Laura Edwards
(74) *Attorney, Agent, or Firm*—Theresa M. Seal

(57) ABSTRACT

An adjustable paint guard for filling the opening of a door frame so that one side of the door frame can be quickly painted without having paint strike the other side of the door frame includes a multi-panel nested arrangement wherein at least one panel serves as the stationary base panel from which the other panels are capable of selective and independent slidable movement along an x-y axis whereupon all the panels can be brought into abutting relationship with the interior vertical and horizontal portions of the door frame that surround the opening thereby completely filling the opening of the door frame and closing off the opening so that paint cannot reach the opposite side of the door frame.

8 Claims, 5 Drawing Sheets

ADJUSTABLE PAINT GUARD FOR DOOR FRAMES

The present invention pertains to shields and guards for filling an opening, and more particularly pertains to an adjustable paint guard for placement within the opening of a door or window frame to make the painting more efficient and less wasteful.

BACKGROUND OF THE INVENTION

Numerous problems are encountered when cleaning, finishing, refinishing or painting the window and door frames, sashes and panes, and more particularly, the area adjacent the window or door opening, that may or may not be filled with a glass pane.

In view of the above problems encountered in painting door and window panes, sashes and frames, shutters, wall areas adjacent trim and moldings, etc., the prior art discloses a range of devices and methods for facilitating such painting in an efficient and controlled manner. A first step in painting window and door frames and panes is to tape and cover the areas adjacent the opening in order to prevent paint from being splattered and streaked thereon. However, this can be a time-consuming and painstaking process, and if not done thoroughly will still leave surface areas on the frame or pane uncovered and exposed to paint smearing and streaking. Some prior art devices that attempt to surmount this problem include handheld paint guards that are positioned adjacent to the window to prevent paint from splattering upon the window and window pane. However, such paint guards are awkward to use, as they must be moved about the window pane during the painting process.

In addition, many houses and structures include shutters adjacent each window, and shutters require maintenance in the form of finishing, cleaning and painting while avoiding the splattering or marring of the window or the exterior surface surrounding the shutter and window. Thus, devices have been conceived to enclose or cover the shutter to protect the window and exterior surface. Moreover, there is also the need to protect window and door frames, sashes and panes that are being painted or treated as part of an assembly process in a factory or on site, such as on a residential or commercial construction site. Such construction sites can include a residential housing plan, a hotel, or a commercial mall where a large number of window or door frames must be painted quickly and efficiently for installation. In such situations, paint guards and shields that can be easily mounted to one frame and then dismounted therefrom for mounting to the next frame are desirable to prevent paint spray and splatter from reaching the non-paintable side of the frame. Paint guards and shields are especially useful in these circumstances as the painting is by a paint sprayer that is quicker—but obviously messier—than a brush. In order to meet the above situations, the prior art discloses a variety of paint guards, shields and protection devices.

For example, the Van Barriger patent (U.S. Pat. No. 3,565,038) discloses a paint masking tool that includes panels that partially overlap one another and each of which includes a knob so that they can be manually moved with respect to each other for covering molding so that the adjacent wall surfaces can be painted.

The Vanstrom patent (U.S. Pat. No. 4,196,692) discloses an adjustable paint guard that includes a frame within which are disposed four generally triangular-shaped sections that are movable by either a camming action or through telescoping arms from an open position to a closed position for closing off the door or window opening within which the guard is placed.

The Adams patent (U.S. Pat. No. 4,276,852) discloses a painting and misting shield that includes a shield with a trough at the bottom for collecting excess spray and mist for possible future use.

The Keith patent (U.S. Pat. No. 4,411,219) discloses a framework for covering a door or window opening that includes frame members that are adjustable for fitting to the given frame and a flexible cover mounted on rollers for covering the opening of the door or window.

The Pullens patent (U.S. Pat. No. 4,620,503) discloses a shutter masking device that includes a pair of l-shaped panels that slide relative to each other through a tongue and groove arrangement for covering the area around a shutter so that the shutter can be cleaned, finished or painted without soiling or marking the siding or window adjacent to the shutter.

The Gleason et al. patent (U.S. Pat. No. 4,791,007) discloses a paint shield that includes a planar member and a blade portion for protecting the edge of a frame and a handle for positioning the planar member for covering the door or window frame.

The Brown patent (U.S. Pat. No. 5,429,677) discloses a device for adjustably protecting surfaces adjacent door or window openings and includes a series of adjustable fins interconnected to a manually operable pole that is to adjoined the fins by a hinging element.

The Poague patent (U.S. Pat. No. 5,853,811) discloses a spray shield that includes a planar element having support arms for hooking over the article to be treated, such as the top railing of a fence, and a trough at the bottom of the planar element for catching excess spray or paint.

The Erdfarb patent (U.S. Pat. No. 6,103,974) discloses a paint cover for electrical outlets, switch assemblies and door knob covers and includes a square, rectangular or circle-shaped cover having a flexible arm for mounting to the article to be covered.

Nonetheless, despite the ingenuity of the above devices, there remains a need for a paint cover, guard or shield that can be easily and quickly set up for minimizing the wastage and mess when painting door or window frames or panes, especially in an assembly line, bulk quantity manner.

SUMMARY OF THE INVENTION

The present invention comprehends an adjustable paint guard or shield for placement within the opening of a door or window frame, pane or sash, for completely filling the opening in order to prevent paint that is either being brushed or sprayed on the facing side of the door or window frame from reaching the opposite, non-paintable side of the frame. The adjustable paint guard includes a nested multi-panel arrangement wherein at least one panel serves as the stationary base or main panel with the other panels being selectively slidable and movable therefrom in both the x and y axis for completely filling the opening of the frame. The panels are slidable and movable independent of each other and can be locked into place upon filling the opening, and easily unlocked for removal and placement in the next door or window frame.

It is an objective of the present invention to provide an adjustable paint guard that allows one side of a door frame to be painted while minimizing or eliminating the mess generally associated with such painting.

It is another objective of the present invention to provide an adjustable paint guard that is a time-saving accessory for painting contractors that must paint a large number of door frames during new construction or remodeling projects.

It is yet another objective of the present invention to provide an adjustable paint guard that can be set up quickly for protecting the door opening and the opposite side of the door frame when using a paint sprayer to paint the door frame.

It is still yet another objective of the present invention to provide an adjustable paint guard that eliminates the need to interrupt the paint spraying process by using a paint brush, and thereby allows the contractor to use a paint sprayer throughout the painting process thereby reducing the time needed to complete the job of painting the door frame.

Yet another objective of the present invention is to provide an adjustable paint guard that is easily adjustable to completely fit the openings of door frames of various sizes and dimensions.

Still yet another objective of the present invention is to provide an adjustable paint guard for painting door frames that is lightweight, durable and easily and quickly movable from one door frame to the next door frame for painting a large number of door frames such as on a construction site.

Still yet a further objective of the present invention is to provide an adjustable paint guard for painting door frames that can also be adapted for use as a baby gate or dog gate.

A still further objective of the present invention is to provide an adjustable paint guard for painting door frames that can be placed within the door opening for preventing dust, dirt and noise from entering the existing home while doing home renovations or additions.

These and other objects, features and advantages will become apparent to one skilled in the art upon a perusal of the following detailed description read in conjunction with the accompanying drawing figures.

DETAILED DESCRIPTION OF THE PREFERRED EMBODIMENT

Illustrated in FIGS. 1–6 is an adjustable paint shield 10 for use with window and door frames, panes and sashes, and which is especially useful for preventing paint from reaching the opposite side—the unpainted side—of the frame, thereby assuring that only the facing side of the frame receives the paint. While the paint shield 10 can be used with a single door or window frame, it is ideally suited for use on a residential or commercial construction site, such as at a large housing plan under development or a mall under construction, where a large number of frames need to be quickly and efficiently painted. Thus, the adjustable paint shield 10 of the present invention is a lightweight (preferably manufactured from plastic), durable, manually portable and easily washable device that speeds up the painting of frames as the paint shield 10 can be quickly placed within one frame, the frame can be painted, and then the shield 10 can be easily removed for placement within the next frame to be painted. Use of this paint shield 10 substantially reduces the time needed to paint the desired surface of the door frame while preventing paint from reaching the opposite side of the frame and preventing the usual mess.

Figure 2:
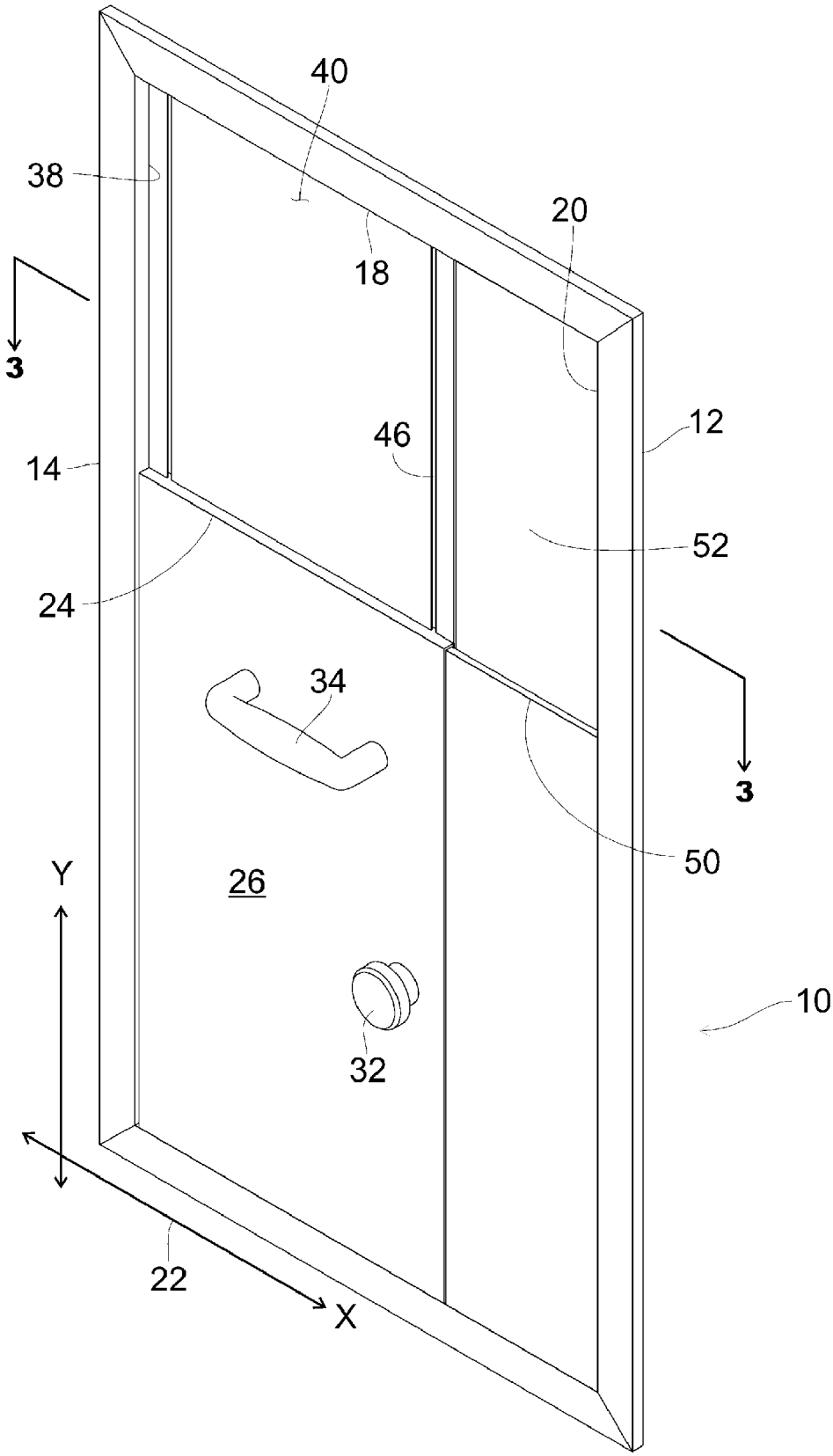
FIG. 2 is a perspective view of the adjustable paint guard of the present invention illustrating the disposition of the paint guard within the opening of a door frame and completely covering the opening of the door frame.
Figure 3:
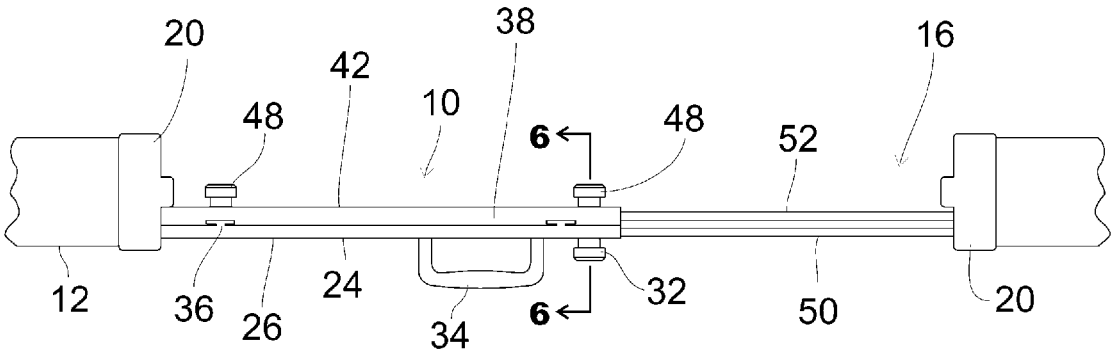
FIG. 3 is a top plan view of the adjustable paint guard illustrating the disposition of the paint guard disposed within the framework of the door frame.
Figure 4:
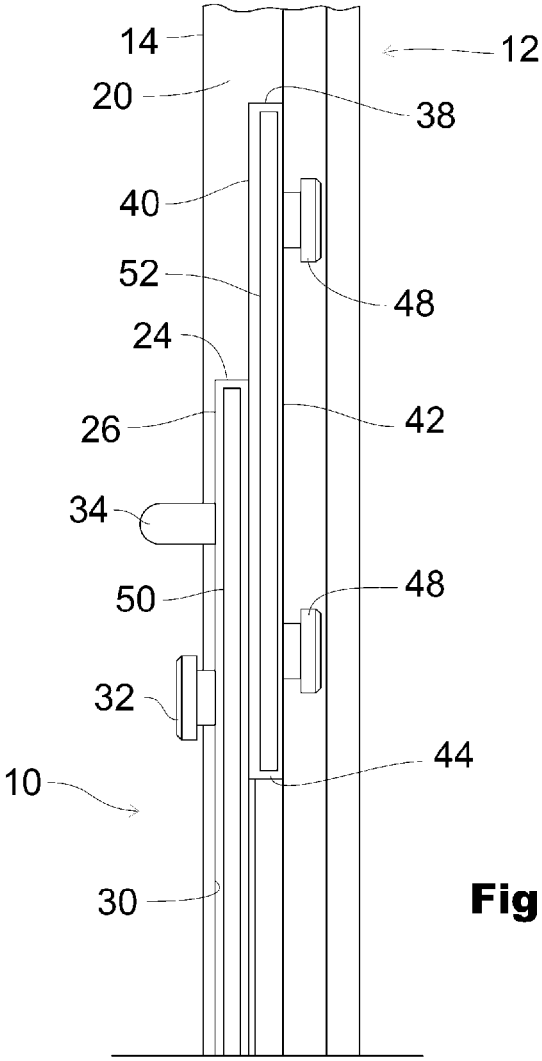
FIG. 4 is a side elevational view of the adjustable paint guard illustrating the disposition of the structural elements that are slidable with respect to each other for filling the opening of the door frame.

Illustrated in FIGS. 2–4 is a representative door frame 12 that includes a generally rectangular-shaped framework 14 surrounding an opening 16 for receiving the window. The framework 14 that surrounds the window opening 16 includes upper and lower horizontal portions or members 18 and opposed vertical portions or members 20. For explanatory purposes as will be hereinafter described, x-y axes 22 are shown in FIG. 2. The adjustable paint shield 10 includes a plurality of nested panels that are capable of selective manual slidable extension in both the horizontal direction and along the x-axis, and in the vertical direction along the y-axis. Furthermore, the panels are independently slidably movable and extendible so that not all the panels are required to slide when one panel slides. The adjustable paint shield 10 thus comprises a multi-panel nested arrangement that is adjustable to accommodate variously sized door frames and openings. The adjustable paint shield 10 thus provides maximum flexibility of use so that the adjustable shield 10 can be placed within the openings of variously sized door frames whereupon the appropriate panels are slidably extended for completely filling and covering the opening 16. When the panels are fully extended and deployed, as shown in FIG. 2, they completely fill and cover the opening 16 so that paint is applied by a paint sprayer to only the facing side of the door frame 12 and is prevented from splattering, streaking or reaching the opposite side of the door frame 12.

The nested multi-panel adjustable paint shield 10 of the present invention includes at least four panels, one of which is the base or main panel 24. The base panel 24 is the stationary or non-extendible panel, and is the panel from which the other panels slidably extend in both the vertical and horizontal directions. The base panel 24 includes a front side 26, an opposite rear side 28 and a main panel cavity 30. A base panel locking and releasing manually operable knob 32 is mounted on the front side 26. The base panel locking and releasing knob 32 is threadably mounted to the front side 26 and can be extended within the main panel cavity 30 and retracted or withdrawn therefrom. Also, a handle 34 is mounted on the front side 26, and the handle 26 can be gripped by the worker or painter for placing the paint shield 10 within the opening 16 of the frame 12 and for removing the paint shield 10 from the frame 12 after the frame 12 has been painted. Mounted on the rear side 28 of the base panel 24, and extending vertically along the full height of the base panel 24, is a pair of spaced-apart track or guide means. For stability of movement one pair of track means are preferred, and the track or guide means include one pair of spaced-apart t-shaped runners or members 36 that extend along the full vertical height of the rear side 28 of the base panel 24.

Illustrated in FIGS. 1–5 is a first slidable panel 38 that is slidably connected to the base panel 24. More specifically, the first slidable panel 38 includes an inner side 40 that is adjacent the rear side 28 of the base panel 24 and an opposite exterior side 42. The first slidable panel 38 also includes a first panel cavity 44. The first slidable panel 38 is snugly and slidably interconnected to the t-shaped members 36 of the base panel 24 through a pair of spaced-apart receiving slots 46 that vertically extend along the full length of the inner side 40. Thus, each receiving slot 46 receives each respective t-shaped member 36 and is slidably extendible thereon for allowing the vertical adjustment and positioning—adjustment and positioning along the y-axis—of the first slidable panel 38. The first slidable panel 38 thus fills or covers the opening 16 of the door frame 12 vertically along the y-axis.

The first slidable panel 38 includes a manual lifting or raising means mounted to the exterior side 42 thereof. The lifting or raising means includes a pair of lifting or raising knobs 48, as shown most distinctly in FIG. 5, that are mounted to the exterior side 42 of the first slidable panel 38. The knobs 48 can be manually gripped for extending or raising the first slidable panel 38 and for lowering the first slidable panel 38 back to the non-deployed position.

Figure 5:
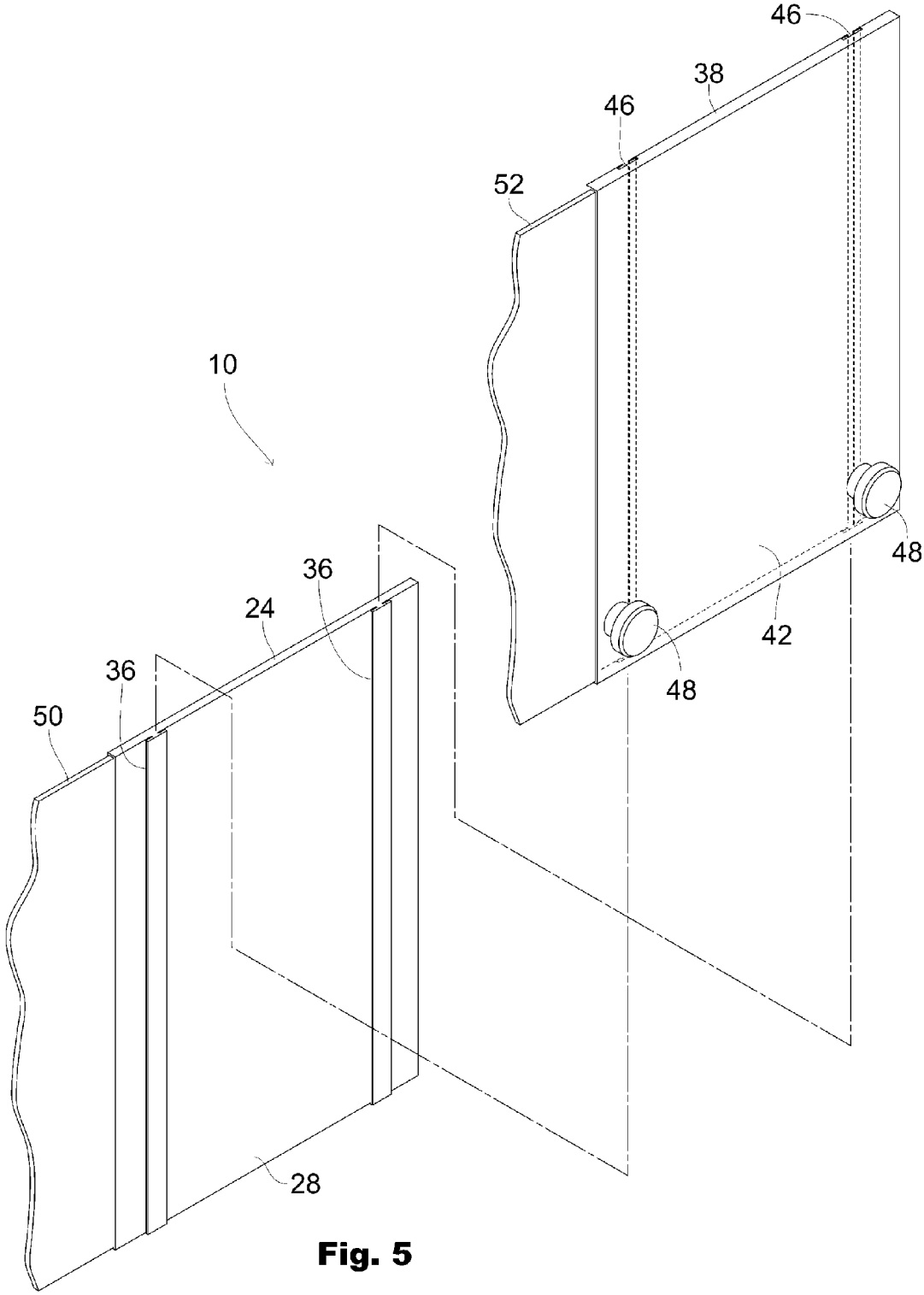
FIG. 5 is an exploded view of the adjustable paint guard illustrating several structural elements separated from each other to show their slidable interfitting arrangement.
Figure 6:
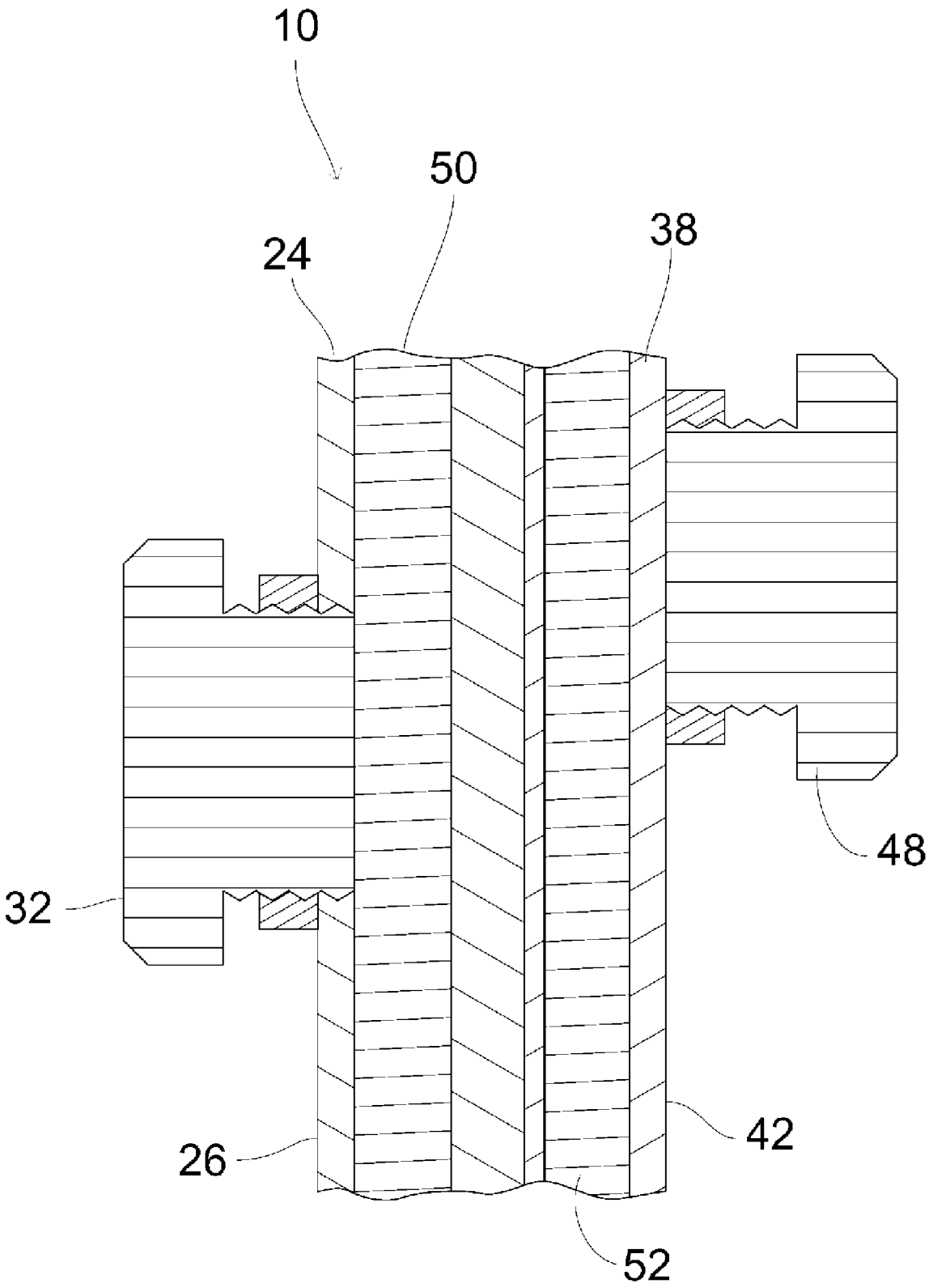
FIG. 6 is a sectioned elevational view of the adjustable door frame taken along lines 6—6 of FIG. 3 illustrating the disposition of two release and locking members.

As shown in FIGS. 1–5, the nested multi-panel adjustable paint shield 10 also includes a first auxiliary panel 50 that is disposed or contained within the main panel cavity 30 of the base panel 24. The first auxiliary panel 50 is slidably movable and extendible from the main panel cavity 30 in the horizontal direction along the x-axis for abutting the vertical portion 20 of the framework 14 of the door frame 12. After the first auxiliary panel 50 has been appropriately extended and positioned, as shown for example in FIG. 2, the base panel locking and releasing knob 32 is turned and tightened against the first auxiliary panel 50 thereby locking the first auxiliary panel 50 in place as shown in FIG. 5.

In addition to the first auxiliary panel 50, the adjustable paint shield 10 also includes a second auxiliary panel 52 that is disposed and contained within the first panel cavity 44 of the first slidable panel 38 as shown in FIGS. 1–5. The second auxiliary panel 52 is movable with the vertical adjustable extension of the first slidable panel 38, but the second auxiliary panel 52 is independently slidably adjustable in the horizontal direction or along the x-axis as shown in FIG. 2. The second auxiliary panel 52 is slidably extended to abut the vertical portion 20 of the framework 14, and can be repositioned, readjusted or returned to its non-deployed position of containment within the first panel cavity 44.

Figure 1:
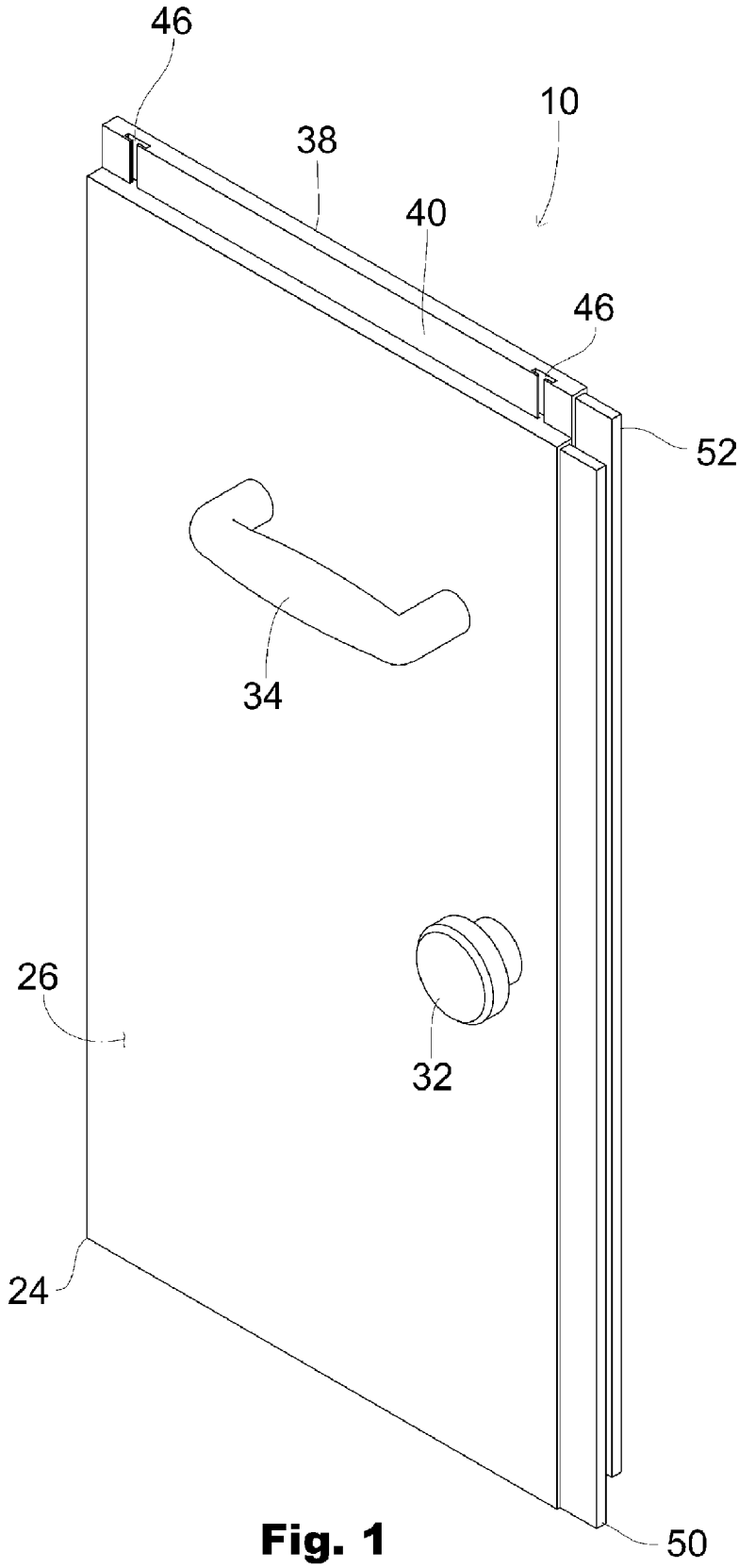
FIG. 1 is a perspective view of the adjustable paint guard of the present invention in the non-deployed disposition.

Although the adjustable length and width of the adjustable paint shield 10 can vary, one preferred adjustable range from the non-deployed state, as shown in FIG. 1, to the fully deployed state, as shown in FIG. 2, is from five feet five inches to eight feet in the vertical direction, or along the y-axis, and from two feet to six feet in the horizontal direction and along the x-axis. This vertical and horizontal adjustable and extendible range assures that the paint shield 10 will completely fill the opening 16 of any door frame 12 currently in use. It should also be noted that the paint shield 10 can be adapted for use as a baby gate or dog gate whereupon the paint shield 10 is placed within the door frame 12 for preventing either a baby or a pet dog (or any pet) from wandering out of the house. In fact, the paint shield 10 can be used as a gate in the doorway of any room of a house to either prevent the child or pet from exiting that particular room, or for blocking entrance to a particular room so that the child or pet is barred from entering a room that the adults do not want the child or pet in. In addition, the paint shield 10 can be placed in the door frame 12 to prevent dust, dirt, and noise from getting into the house during home renovation and addition. Also, the paint shield 10 can be used to block off a room or portion of the house undergoing some type of construction or renovation so that dirt, dust and noise does not permeate the other rooms of the house.

Although a preferred embodiment has been shown and described, it will be apparent to those skilled in the art that numerous modifications, alterations and variations are possible and practicable without departing from the spirit of the invention or the scope of the appended claims.

What is claimed is:

1. An adjustable paint guard for filling an opening of a window or door frame so that paint is applied to only one side of the frame and prevented from reaching an opposite side of the frame, comprising:

a multi-panel nested arrangement wherein the panels are selectively and independently slidable and movable with respect to each other;

the panels further characterized by a base panel that is stationarily disposed within the frame;

the base panel including a main panel cavity and a front side and a rear side;

a handle mounted to the front side for positioning the base panel within the frame and for removal of the base panel therefrom;

track means mounted to the rear side and vertically extending thereon;

a first slidable panel mounted to the base panel for slidable adjustable movement thereon;

the first slidable panel having a first panel cavity and a pair of receiving slots for interconnection to the track means of the base panel;

a first auxiliary panel disposed within the main panel cavity of the base panel for slidable adjustable movement therefrom;

a second auxiliary panel disposed within the first panel cavity of the first slidable panel for adjustable slidable movement therefrom; and whereupon the base panel is positioned within the frame so that the first slidable panel can be slidably moved in a vertical direction and the first auxiliary panel and the second auxiliary panel can be slidably moved in a horizontal direction so that the base panel, the first slidable panel, the first auxiliary panel and the second auxiliary panel abut the frame and thereby completely fill the opening of the frame so that pain cannot reach the opposite side of the frame.

2. The adjustable paint guard of claim 1 wherein the track means includes a pair of t-shaped track members.

3. The adjustable paint guard of claim 2 wherein the first slidable panel includes an inner side that is adjacent the rear side of the base panel and an opposite exterior side.

4. The adjustable paint guard of claim 3 wherein the receiving slots are located on the inner side of the first slidable panel and each receiving slot is slidably interconnected to each respective t-shaped member located on the rear side of the base panel.

5. An adjustable paint guard for completely covering an opening of a window or door frame so that paint is applied to only one side of the frame and prevented from reaching an opposite side of the frame, comprising:

a base panel having a main panel cavity, a front side and an opposite rear side, a handle mounted to the front side for positioning the base panel within the frame and for removing the base panel therefrom, and a track means mounted to the rear side and vertically extending therefrom;

a first slidable panel mounted to the base panel for slidable adjustable movement thereon and including a first panel cavity, and a pair of receiving slots for interconnection to the track means;

a first auxiliary panel disposed within the main panel cavity for slidable adjustable movement therefrom in a generally horizontal direction;

a second auxiliary panel disposed within the first panel cavity for slidable adjustable movement therefrom in a generally horizontal direction; and whereupon the base panel is placed within the frame so that the first slidable panel can be slidably adjusted in a vertical direction and the first auxiliary panel and the second auxiliary panel can be slidably adjusted in the horizontal direction so that the base panel, the first slidable panel, the first auxiliary panel, and the second auxiliary panel completely fill the opening and abut the frame thereby preventing paint from reaching the opposite side of the frame.

6. The adjustable paint guard of claim 5 wherein the track means includes a pair of t-shaped track members.

7. The adjustable paint guard of claim 6 wherein the first slidable panel includes an inner side that is adjacent the rear side of the base panel and an opposite exterior side.

8. The adjustable paint guard of claim 7 wherein the receiving slots are located on the inner side of the first slidable panel and each receiving slot is slidably interconnected to each respective t-shaped member located on the rear side of the base panel.

* * * * *